US010600630B2

(12) United States Patent
Hoyes et al.

(10) Patent No.: US 10,600,630 B2
(45) Date of Patent: Mar. 24, 2020

(54) OVERSAMPLED TIME OF FLIGHT MASS SPECTROMETRY

(71) Applicant: Micromass UK Limited, Wilmslow (GB)

(72) Inventors: John Brian Hoyes, Stockport (GB); Richard Denny, Newcaste-under-Lyme (GB); Jason Lee Wildgoose, Stockport (GB); Peter Nixon, Winsford (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 15/572,091

(22) PCT Filed: May 6, 2016

(86) PCT No.: PCT/GB2016/051304

§ 371 (c)(1),
(2) Date: Nov. 6, 2017

(87) PCT Pub. No.: WO2016/178029

PCT Pub. Date: Nov. 10, 2016

(65) Prior Publication Data

US 2018/0144920 A1 May 24, 2018

(30) Foreign Application Priority Data

May 6, 2015 (GB) ..... 1507759.7

(51) Int. Cl.
*H01J 49/40* (2006.01)
*H01J 49/00* (2006.01)

(52) U.S. Cl.
CPC ..... *H01J 49/40* (2013.01); *H01J 49/004* (2013.01); *H01J 49/0031* (2013.01)

(58) Field of Classification Search
None
See application file for complete search history.

(56) References Cited

U.S. PATENT DOCUMENTS 6,300,626 B1 * 10/2001 Brock ..... H01J 49/0027 250/287
6,521,887 B1 * 2/2003 Funsten ..... H01J 49/061 250/287

(Continued)

FOREIGN PATENT DOCUMENTS

CN 103824750 A 5/2014
JP H07211285 A 8/1995

(Continued)

OTHER PUBLICATIONS

Trapp et al., "Continuous Two-Channel Time-of-Flight Mass Spectrometric Detection of Eleectrosprayed Ions", Angew. Chem. Int. Ed. (Year: 2004).*

(Continued)

*Primary Examiner* — Michael J Logie

(57) ABSTRACT

A method of mass spectrometry is disclosed comprising passing ions to an oversampled Time of Flight mass analyser (4) and sequentially recording ion signals on a plurality of different channels (51, 52) to obtain a plurality of first oversampled mass spectral data sets of reduced complexity. An upstream separation device (3) may be provided to further reduce the complexity of each of the mass spectral data sets.

18 Claims, 3 Drawing Sheets

(56) References Cited

U.S. PATENT DOCUMENTS

2004/0183007 A1* 9/2004 Belov ..... H01J 49/0027 250/287
2004/0195520 A1* 10/2004 Bateman ..... H01J 43/246 250/397
2005/0001163 A1* 1/2005 Belov ..... H01J 49/0027 250/290
2005/0189484 A1* 9/2005 Glukhoy ..... H01J 49/0445 250/287
2005/0194531 A1* 9/2005 Chernushevich ... H01J 49/0031 250/288
2007/0023645 A1* 2/2007 Chernushevich ..... H01J 49/40 250/287
2009/0057550 A1* 3/2009 Stults ..... G06F 19/24 250/282
2010/0051799 A1* 3/2010 Makarov ..... H01J 49/004 250/282
2013/0161506 A1* 6/2013 Ugarov ..... G01N 27/62 250/282
2013/0327935 A1* 12/2013 Wiedenbeck ..... H01J 49/061 250/282
2014/0138526 A1* 5/2014 Goldberg ..... H01J 49/40 250/252.1
2015/0364305 A1* 12/2015 Wang, Jr. ..... H01J 49/0036 250/282
2016/0086783 A1* 3/2016 Cox ..... H01J 49/0027 250/282
2016/0172171 A1* 6/2016 Wang ..... H01J 49/0036 702/196
2016/0195466 A1* 7/2016 Loboda ..... G01N 15/1056 506/9
2016/0225602 A1* 8/2016 Ristroph ..... H01J 49/009
2016/0336161 A1* 11/2016 Grothe, Jr. ..... H01J 49/025
2017/0125226 A1 5/2017 Hoyes

FOREIGN PATENT DOCUMENTS

JP 2002367558 A 12/2002
JP 2007526458 A 9/2007
JP 2013519198 A 5/2013
JP 2013525986 A 6/2013
JP 2013134251 A 7/2013
JP 2014501430 A 1/2014
WO 2003071569 A2 8/2003
WO 2011135477 A1 11/2011

OTHER PUBLICATIONS

Search Report Under Section 17(5) for Application No. GB1507759.7 dated Apr. 19, 2016.
International Search Report and Written Opinion of the International Search Authority for Application No. PCT/GB2016/051304 dated Jul. 20, 2016.

* cited by examiner

OVERSAMPLED TIME OF FLIGHT MASS SPECTROMETRY

CROSS-REFERENCE TO RELATED APPLICATION

This application claims priority from and the benefit of United Kingdom Patent Application No. 1507759.7 filed on 6 May 2015. The entire contents of this application are incorporated herein by reference.

FIELD OF THE INVENTION

The present invention relates generally to mass spectrometry and in particular to methods of mass spectrometry and mass spectrometers.

BACKGROUND

In Time of Flight ("TOF") mass spectrometry a mixture of species of differing masses is accelerated into a mass analyser and the ions are separated according to their mass to charge ratio. Enough time is allowed for the largest mass to charge ratio species of ion present in the mixture to reach an ion detector before a next or subsequent acceleration event is initiated, in a so-called "pulse-and-wait" approach. This technique has an inherently low duty cycle and sensitivity, especially when used with continuous ion sources. For instance, in the case of an orthogonal acceleration folded flight path ("FFP") Time of Flight analyser waiting for this length of time leads to very low duty cycles (e.g. 0.3% or less).

It is known that the low duty cycle can be mitigated to some extent by sampling more often than that determined by the flight time of the largest mass to charge ratio species of ion and then demultiplexing the resulting spectral data in a process which is known as "oversampling".

However, one problem with this approach is that when the oversampling approach is utilised with rich and complex spectra (such as is often found in liquid chromatography mass spectrometry experiments) then the resulting data can include too many peak overlaps for successful demultiplexing.

With current low duty cycle (0.3% or less) folded flight path analysers it is desired to be able to oversample by a factor of approximately 100 in order to achieve substantially improved duty cycles of ~30%.

Accordingly, it is desired to provide an improved method of mass spectrometry.

SUMMARY

According to an aspect there is provided a method of mass spectrometry comprising:

passing ions to a Time of Flight mass analyser operating in an oversampling mode of operation; and alternately or sequentially recording ion signals for the ions on a plurality of different channels to obtain a plurality of first oversampled mass spectral data sets.

The present approach relates to a method of allowing large oversampling rates and with a resulting significantly improved duty cycle whilst retaining the ability to successfully demultiplex the resulting data. By alternately or sequentially recording ion signals on a plurality of different channels, the complexity e.g. the number of peaks or peak overlaps for each data set may be reduced compared to other known arrangements. This allows data sets of greater complexity e.g. resulting from a more complex sample and/or obtained using a higher oversampling rate to be successfully processed. Further improvements in this respect can be achieved by employing an upstream separation of ions prior to arrival of the ions at the Time of Flight mass analyser.

It will be understood that operating a Time of Flight mass analyser with oversampling, or in an oversampling mode of operation, means that the time between extraction pulses (i.e. the pulse rate at which ions are pushed/pulled into a Time of Flight region) is shorter than the time of flight for the slowest ions in the preceding pulse to reach the detector. That is, multiple packets or groups of ions are simultaneously present in the Time of Flight region. It will be appreciated that oversampling provides improvements in duty cycle. However, it will also be appreciated that this results in overlapping spectra which must subsequently be deconvoluted or demultiplexed or otherwise processed in order to provide an intelligible mass spectrum. It should therefore be understood that an oversampled mass spectral data set comprises a data set acquired or obtained by a process of oversampling, such that an oversampled mass spectral data set contains multiple potentially overlapping mass spectra. The techniques described herein allow successful demultiplexing of spectra acquired even at very high oversampling rates, without losing any information.

US 2005/0194531 (Chernushevich) discloses a method where an ion beam is alternately directed to different detection regions to allow for an increase in pulsing frequency. However, the pulse schedule for each detection region still follows the traditional pulse-and-wait approach such that resulting mass spectral data sets are not oversampled and hence no demultiplexing is required. According to the approach disclosed in US 2005/0194531 (Chernushevich), the pulse frequency only increases linearly with the number of different detection regions, and so this approach only allows for a relatively limited or modest increase in duty cycle.

By contrast, for the techniques described herein and which relate to various embodiments, the first mass spectral data sets are each oversampled. Hence, relative to the arrangements disclosed in US 2005/0194531 (Chernushevich), much higher pulsing rates and duty cycles can be achieved, whilst still keeping the complexity of the individual data sets within manageable limits.

It will be appreciated that the ion signals are those that may be processed in order to provide mass spectral data. The ion signals are thus generated by or using the Time of Flight mass analyser. The ion signals may be generated, for instance, at an ion detection or data acquisition system of the Time of Flight mass analyser. The ion signals may thus correspond directly or indirectly to the arrival time of ions at an ion detector or other detection system of the Time of Flight mass analyser. The ion signals may be electronic signals or data corresponding to or indicative of ion arrival or detection events. The different channels may generally be different channels of a Time of Flight detection or data acquisition system.

Each oversampled mass spectral data set may, and typically will, contain multiple Time of Flight spectra. That is, each of the first oversampled mass spectral data set may contain multiple overlapping Time of Flight spectra, such that the mass spectral data sets associated with each different channel are each oversampled (e.g. and may each therefore require demultiplexing).

By alternately or sequentially recording the ion signals on different channels it is meant that the ion signals are recorded on at least two different channels during the course of a single experiment or measurement cycle.

That is, the channel on which the ion signals are recorded will change as a function of time.

The ion signals may be alternately or sequentially recorded on the plurality of different channels in order to keep the complexity of each first mass spectral data set below a desired threshold, in order to facilitate subsequent processing of the first mass spectral data sets. The degree of complexity and/or the desired threshold may e.g. be defined as a number of mass spectral data points i.e. or mass peaks, an ion count, a total ion current, an intensity, or a number of overlapping peaks.

The channel on which the ion signals are recorded may be changed progressively or sequentially. The channel may be changed in a continuous or a stepped manner. The ion signals may be recorded on each of the plurality of different channels in a cyclic or repeated manner during the course of an experiment, so that there are multiple instances of recording the ion signals on each of the plurality of different channels during the course of the experiment.

The method may comprise sequentially recording the ion signals on the plurality of different channels. For instance, the method may comprise alternating (or otherwise changing) the channel on which ion signals are recorded in accordance with a pre-determined sequence. The method may alternatively comprise alternating the channel on which ion signals are recorded according to a random or pseudo-random sequence.

The channel may be changed after a pre-determined time interval, i.e. so that ion signals are recorded on each of the channels for a set amount of time. The time for each channel may be the same, i.e. the time intervals may be equally spaced, or may be different.

It is noted that, generally, the data may be recorded on a large number of different channels. For instance, the ion signals may be alternately or sequentially recorded on about 10 or more, about 20 or more, about 30 or more, about 40 or more, about 50 or more, about 60 or more, about 70 or more, about 80 or more, about 90 or more, up to about 100, or more than about 100 different channels.

The ions may generally arrive at or be passed to the Time of Flight mass analyser in a sequential manner, i.e. according to some temporal function or variation. The ion signals may be directed to the different channels based on this temporal function or variation. For instance, the timescale or frequency for changing the channel may be determined based on the timescale of this temporal function or variation. In particular, the channel may be changed multiple times over the course of the temporal function or variation.

The sequentially arriving ions may be considered to form a plurality of ion groups. The ion groups may be defined arbitrarily e.g. by grouping the ions according to a time interval at which they arrive at the Time of Flight mass analyser. The timescale or frequency for changing the channel may generally be such that different groups are recorded using different channels. That is, a first group of ions (i.e. or data indicative of the first group of ions) passed into the Time of Flight region of the mass analyser at a first time may be recorded on a first channel and ion signals relating to a second group of ions passed into the Time of Flight region of the mass analyser at second later time may be recorded on a second different channel.

A third group of even later ions may be recorded on a third different channel and so on. In particular, where the ions arrive at the Time of Flight mass analyser according to some temporal function or variation (e.g. based on an upstream separation) each of the groups of ions within a single cycle of the temporal function or variation may be recorded on a separate channel. It is also contemplated that ions from later groups, and particularly ions from later cycles or separations, may be recorded using the first channel i.e. the sequence may be repeated or cyclical.

The method may further comprise processing each of the plurality of first oversampled mass spectral data sets to obtain a plurality of second mass spectral data sets; and combining the plurality of second mass spectral data sets to form a composite mass spectrum or mass spectral data set.

The step of processing each of the plurality of first oversampled mass spectral data sets may comprise demultiplexing each of the plurality of first oversampled mass spectral data sets to obtain the plurality of second mass spectral data sets. The demultiplexing may be performed using various known technique e.g. based on knowledge of the Time of Flight acquisition or pulse frequency.

Each of the plurality of first oversampled mass spectral data sets may be processed (or e.g. demultiplexed) separately i.e. independently of the other mass spectral data sets recorded on the different channels.

However, it will be appreciated that it may not be necessary to process each of the first oversampled mass spectral data sets separately and embodiments are contemplated wherein a subset of (i.e. multiple of) the first spectra data sets may be processed together. In particular, this may be done if these data sets are or are determined to be relatively sparse (i.e. to contain relatively few distinct and/or overlapping peaks). Provided that the resulting composite spectrum is not too complex as to prevent successful demultiplexing, the overall complexity of the data being processed at any point and/or the data processing strain may still be sufficiently reduced. Hence, the method may comprise processing at least some or a portion of the plurality of first oversampled mass spectral data sets separately.

The method may comprise separating or filtering the ions according to one or more physico-chemical properties prior to passing them to the Time of Flight mass analyser.

The method may comprise alternately or sequentially recording the ion signals for the ions on the plurality of different channels so that each of the first mass spectral data sets is associated with a value or range of values of the physico-chemical property.

The physico-chemical property may be or may comprise: (i) ion mobility; and/or (ii) differential ion mobility; and/or (iii) collision cross section ("CCS"); and/or (iv) mass or mass to charge ratio; and/or (v) chromatographic retention time.

The ion signals may be alternately or sequentially recorded on the plurality of different channels based on or as a function of the separation/filtering of the ions. By separating or filtering the ions upstream of the Time of Flight mass analyser, the complexity of the spectra at any moment in time can be reduced. The peak density in any individual channel is thus reduced compared to the composite or unseparated signal. The ions may generally be separated or filtered in a known manner.

It will be appreciated that the step of separating or filtering the ions effectively groups or otherwise sorts the ions according to a physico-chemical property. The effect of this step is therefore to introduce a temporal spread or modulation to the ions being passed to the Time of Flight mass analyser. This temporal spread may be defined as a characteristic timescale of the separation or separation device. The characteristic timescale may correspond to the maximum timescale over which ions entering the separation device at the same time may elute from the device i.e. the potential temporal spread introduced by the separation device. It is noted that generally, depending on the type of separation device, the ions may be passed from the separation device to the Time of Flight mass analyser as a plurality of temporally separated ion packets or as a substantially continuous or pseudo-continuous beam containing one or more temporally separated components.

Alternately or sequentially recording the ion signals on a plurality of different channels during the course of a separation or separation cycle (i.e. changing the channel multiple times within the characteristic timescale of the separation device) will have the effect of introducing a correlation between the channel number and the physico-chemical property. That is, ions eluting from the separation device at different times may be recorded on different channels. In particular, the ion signals for ions having different values of the physico-chemical property, or values falling within different ranges of the physico-chemical property, may be recorded on different channels. Ion signals for ions having a value of the physico-chemical property within a first range (i.e. ions forming a first group eluting from the separation device at a first time) may be directed to a first channel whereas the ion signals for ions having values of the physico-chemical property within a second different range (i.e. a second group eluting from the separation device at a second time) may be directed to a second different channel.

The sequence according to which ion signals are recorded or directed to the different channels may thus be determined or based on the ions' elution from the separation device. For instance, the channel on which the ion signal is recorded may be sequentially or progressively changed as a function of the ions' elution from the separation device. The timescale or frequency for changing the channel may thus be selected based on the characteristic timescale of the separation. Generally, the timescale for changing the channel will be shorter than the timescale of separation in the separation device but longer than the Time of Flight separation in the mass analyser.

It will be understood that the characteristic timescale of the separation should therefore be generally larger than the timescale of the Time of Flight separation so that multiple Time of Flight spectra are acquired during the course of each separation—this may be referred to as "nested" Time of Flight acquisition. A full Time of Flight spectrum can thus be recorded for each value of the physico-chemical property. The separation may be nested in time between the Time of Flight and a liquid chromatography ("LC") timescale.

The ion signals may be recorded sequentially to a plurality of different channels as the corresponding ions elute from the separation device.

The separation may separate ions as a function of the one or more physico-chemical property according to a temporal function, f(t), and the ion signals may be recorded on the different channels according to the temporal function.

The separated ions may be grouped or sorted into a plurality of ion groups associated with a particular value or range of values of the physico-chemical property. The ion signals for different groups may be recorded on different channels. A group of ions may thus be defined according to which channel the ion signals for that group are recorded on. As mentioned above, the size of the ion groups may be defined arbitrarily. For example, the groups may be defined by dividing the ion beam into a number of time segments and recording the ion signals within each time segment or at least within adjacent time segments on different channels. As another example, the ion groups may be defined dynamically e.g. the ion channel on which ion signals are currently being recorded may be changed once a certain ion current or intensity threshold is reached.

In particular, the method may comprise: separating or filtering ions according to one or more physico-chemical property; passing the separated or filtered ions to a Time of Flight mass analyser operating in an oversampling mode of operation; sequentially recording ion signals for the ions on a plurality of different channels to obtain a plurality of first oversampled mass spectral data sets each associated with a value or range of values of the one or more physico-chemical property; processing each of the plurality of first oversampled mass spectral data sets to obtain a plurality of second mass spectral data sets; and combining the plurality of second mass spectral data sets to form a composite mass spectrum or mass spectral data set.

The method may comprise separating or filtering the ions according to their ion mobility differential ion mobility or collision cross section ("CCS").

The method may further comprise determining the ion mobility, drift times or collision cross section of the ions. The ion mobility, drift times or collision cross sections may be determined as part of the processing or demultiplexing of the mass spectral data sets. For instance, the ion mobility, drift times or collision cross sections may be reconstructed from the profile information obtained by the oversampled Time of Flight mass analyser. The ion mobility, drift times or collision cross sections may additionally/alternatively be determined by the channel on which the ion signals was recorded. That is, the ion mobility characteristics may be retained and correlated with the channel number.

The method may comprise separating or filtering the ions according to mass or mass to charge ratio.

The method may comprise separating or filtering the ions according to chromatographic retention time.

It will be appreciated that a chromatographic separation device (e.g. a liquid chromatography ("LC") column) may generally be disposed upstream of the ionisation source such that it is the components of a sample from which the ions derive that are chromatographically separated rather than the ions. However, in this case the ions retain the chromatographic separation profile and can thus also be considered to be separated according to retention times or pseudo retention time, and for the purposes of the present application any reference to chromatographic separation of ions should be understood to include this.

The components from which the ions derive may be first separated according to chromatographic retention time and then according to e.g. ion mobility or mass to charge ratio prior to the Time of Flight separation. In this case, the separations should generally be nested in time such that the characteristic timescales of separation decrease along the instrument.

As mentioned above, the method may comprise alternating the channel after a fixed or pre-determined time interval. However, the method may alternatively comprise alternating the channel on which ion signals are recorded dynamically. For instance, the method may comprise alternating the channel on which ion signals are recorded dynamically after an ion signal threshold for a channel is reached. The ion signal threshold may e.g., represent a pre-determined number of counts or a certain ion current or intensity threshold for each channel. The method may comprise recording the number of counts, ion current or intensity threshold and automatically alternating between channels once the threshold is reached.

The step of operating the Time of Flight mass analyser in an oversampling mode of operation may further comprise employing encoded frequent pulses ("EFP").

EFP is a particular type of oversampling or multiplexing which may e.g. suitably be adopted in a folded flight path orthogonal acceleration Time of Flight mass analyser. However, the use of EFP is not limited to a particular type of Time of Flight mass analyser.

The principles of EFP are described, for example, in WO 2011/135477 (Verenchikov). In the EFP technique, the Time of Flight acquisition or pulse frequency is set according to a variable or pseudo-random sequence. The resulting data can subsequently be demultiplexed based on knowledge of this sequence. Varying the pulse rate in this way may help avoid unintentionally introducing biasing-type errors that may otherwise occur when operating a Time of Flight with a fixed oversampled acquisition rate.

The step of alternately or sequentially recording ion signals on the plurality of different channels may comprise scanning or rastering across the area of a multiple pixel Time of Flight detector, and the plurality of different channels may comprise designated or discrete areas or pixels of the detector. The multiple pixel Time of Flight detector may comprise a two-dimensional array.

Scanning or rastering across the area of the detector may comprise progressively varying one or more deflection potentials or waveforms applied to one or more deflection electrodes. The scan rate may be determined based on a characteristic timescale of a separation.

The plurality of different channels may comprise separate memory locations in a data acquisition system.

According to another aspect there is provided a Time of Flight mass analyser operable in an oversampling mode of operation comprising:

a control system arranged and adapted, in the oversampling mode of operation, to alternately or sequentially record ion signals on a plurality of different channels to obtain a plurality of first mass spectral data sets.

The control system may be arranged and adapted to perform a method as described or containing any of the features described above. The control system may comprise any suitable control and/or processing circuitry arranged and adapted to record the ion signals on the plurality of different channels. The Time of Flight mass analyser may further comprise any suitable processor or processing circuitry for subsequently processing the ion signals, e.g. in the manner described above.

The Time of Flight mass analyser may comprise any suitable means for alternately or sequentially recording the ion signals on the plurality of different channels. For instance, the Time of Flight mass analyser may comprise various electrode or ion optical arrangements for doing this.

The Time of Flight mass analyser may comprise various known Time of Flight instruments. For instance, the Time of Flight mass analyser may comprise a linear or orthogonal acceleration Time of Flight mass analyser. The Time of Flight mass analyser may comprise an extended or folded flight path Time of Flight mass analyser. Typically, the Time of Flight mass analyser may comprise an ion acceleration region and a Time of Flight region. Ions may be accelerated from the ion acceleration region e.g., using one or more extraction pulses into the Time of Flight region where they separate according to time of flight i.e. mass or mass to charge ratio. At the end of the Time of Flight region, the ions arrive at an ion detector or detection system. The output of the ion detector or detection system may be processed to provide mass spectral data. The Time of Flight mass analyser generally comprises a processor for processing e.g. demultiplexing the mass spectral data sets. The processor may comprise a user's computer running appropriate software.

The Time of Flight mass analyser may further comprise a separation device for separating or filtering ions according to one or more physico-chemical property.

The ions may be separated or filtered prior to being passed to the Time of Flight mass analyser. The separation device may be disposed upstream of the Time of Flight mass analyser.

The separation device may comprise: (i) an ion mobility or differential ion mobility separation device; (ii) a mass or mass to charge ratio separation device; (iii) a mass selective ion trap; and/or (iv) a mass selective ion filter.

Each of the different channels may comprise a designated or discrete area or pixel of a multiple pixel Time of Flight detector.

In this case, the device for alternately or sequentially recording the ion signals on the plurality of different channels may comprise one or more deflection lenses. The control system may be arranged to progressively scan potentials or waveforms applied to the deflection lenses to scan or raster across the area of the Time of Flight detector.

Each of the different channels may comprise a separate memory location in a data acquisition system.

The device for alternately or sequentially recording ion signals on a plurality of different channels may comprise one or more deflection lenses.

According to an aspect there is provided a mass spectrometer comprising a Time of Flight mass analyser as described above.

According to a further aspect there is provided a method comprising:

passing ions to a Time of Flight mass analyser operating in an oversampling mode of operation; and sequentially recording ion signals for the ions on a plurality of different channels in order to obtain a plurality of first mass spectral data sets.

According to another aspect there is provided a Time of Flight mass analyser operable in an oversampling mode of operation, comprising:

a control system arranged and adapted, in the oversampling mode of operation, to sequentially record ion signals on a plurality of different channels in order to obtain a plurality of first mass spectral data sets.

The method and Time of Flight mass analyser of these aspects may further comprise any or all of the steps or features, or the control system may be further arranged and adapted to perform any or all of the steps, described herein.

According to an aspect there is provided a Time of Flight mass spectrometer operated or operable in oversampling mode comprising:

an upstream separation device whereby in use ion signals detected by the Time of Flight mass analyser are directed sequentially to a plurality of different channels as they elute from the separation device, thereby reducing the peak density in any individual channel when compared to the composite unseparated signal; and wherein the ion signals in each channel are demultiplexed separately.

The separation may generally be nested in time between chromatographic and Time of Flight timescales.

The separation device may separate according to ion mobility.

The separation device may comprise a mass selective ion trap.

The separation device may comprise a mass selective ion filter.

The oversampling technique employed may comprise an encoded frequent pulsing ("EFP") technique.

Each channel may comprise a designated area of a multiple pixel Time of Flight detector.

Each channel may alternatively or additionally be or comprise a separate memory location in a data acquisition system.

The mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a Time of Flight mass analyser; (ii) an orthogonal acceleration Time of Flight mass analyser; and (iii) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The mass spectrometer may further comprise a device arranged and adapted to supply an AC or RF voltage to the electrodes. The AC or RF voltage may have an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage may have a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The mass spectrometer may comprise a chromatography detector.

The chromatography detector may comprise a destructive chromatography detector optionally selected from the group consisting of: (i) a Flame Ionization Detector ("FID"); (ii) an aerosol-based detector or Nano Quantity Analyte Detector ("NQAD"); (iii) a Flame Photometric Detector ("FPD"); (iv) an Atomic-Emission Detector ("AED"); (v) a Nitrogen Phosphorus Detector ("NPD"); and (vi) an Evaporative Light Scattering Detector ("ELSD").

Additionally or alternatively, the chromatography detector may comprise a non-destructive chromatography detector optionally selected from the group consisting of: (i) a fixed or variable wavelength UV detector; (ii) a Thermal Conductivity Detector ("TCD"); (iii) a fluorescence detector; (iv) an Electron Capture Detector ("ECD"); (v) a conductivity monitor; (vi) a Photoionization Detector ("PID"); (vii) a Refractive Index Detector ("RID"); (viii) a radio flow detector; and (ix) a chiral detector.

The ion guide may be maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

BRIEF DESCRIPTION OF THE DRAWINGS

Various embodiments will now be described, by way of example only, and with reference to the accompanying drawings in which.

DETAILED DESCRIPTION

The general principle underlying the techniques described herein is illustrated with reference to FIG. 1. Ion signals or data generated by a Time of Flight mass analyser 4 operating with oversampling are recorded or directed to one of a plurality of different channels of an ion detection or data acquisition system according to a temporal function, F(t), i.e. the channel on which ion signals are recorded is changed as a function of time. The complexity of data (e.g. peak density) on any individual channel is thereby reduced, facilitating successful demultiplexing of the oversampled spectra. It will be apparent, therefore, that the approach according to various embodiments is particularly beneficial.

Figure 1:
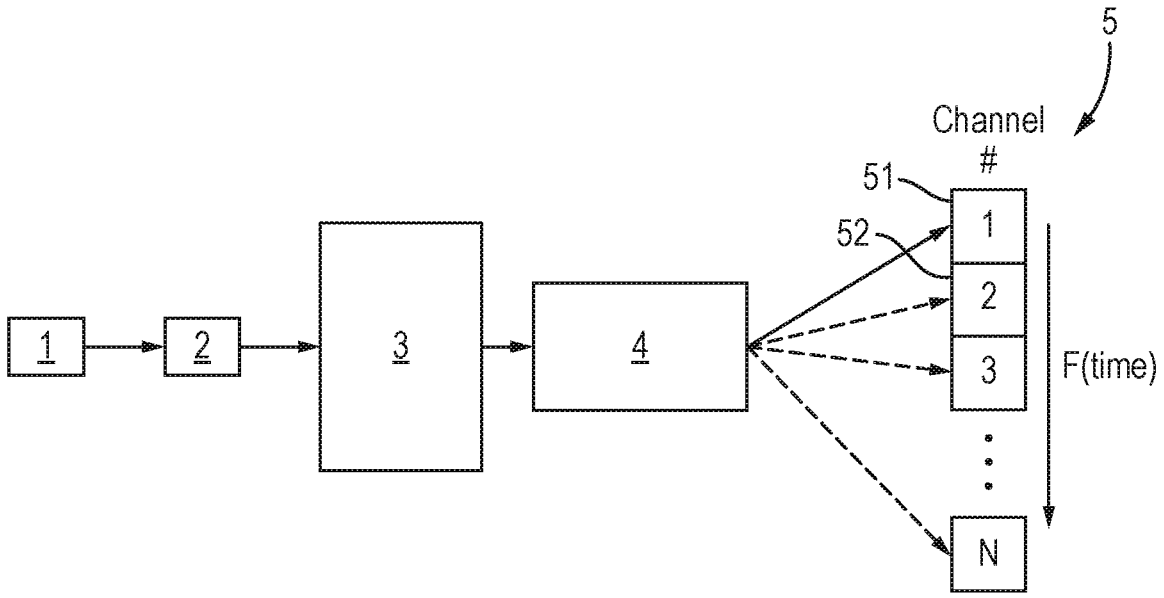
FIG. 1 shows a schematic view of an instrument according to an embodiment on which the techniques described herein may be implemented.

In the schematic geometry shown in FIG. 1, a sample may be introduced into the mass spectrometer via a chromatographic interface 1 (e.g. an LC column) and ionisation source 2 (e.g. electrospray). The resulting analyte ions then pass through a separation device 3 which is arranged to separate ions according to a physico-chemical property (such as mass or mass to charge ratio, ion mobility, differential ion mobility or collision cross section) before the ions arrive at a Time of Flight mass analyser 4 operating in an oversampling mode. The separation of the ions in the separation device 3 may be nested in time between the chromatographic and Time of Flight timescales. The data generated by the Time of Flight mass analyser 4 may then be directed to one of N different channels 51,52 of a detector system 5. The timescale for changing the channel is set to be shorter than the timescale of the separation of the ions by the separation device 3 so that different groups of ions associated with different physico-chemical values are recorded on different channels. The timescale for changing the channel is, however, generally arranged to be slower than the acquisition rate of the Time of Flight mass analyser 4, such that the data sets recorded on each of the channels contain multiple Time of Flight spectra with overlapping peaks.

It will be appreciated, however, that the techniques described herein are not limited to the particular instrument geometry illustrated in FIG. 1. For instance, the technique is not limited to any particular interface and/or ion source arrangement. Similarly, the instrument may further comprise various other components located along the instrument, including one or more ion guides, reaction or collision cells, mass filters, separation devices, and/or ion traps.

The upstream separation device 3 may be arranged to group or sort ions according to one or more physico-chemical properties and hence introduces a temporal spread or modulation to the ion beam. Ions introduced into the separation device at the same time will generally be separated from each other up to a maximum characteristic timescale of the device. The separation may serve to reduce the complexity (richness) of the eluting spectra at any moment in time. The peak density at any moment in time is thus reduced i.e. relative to the composite or unseparated spectra. Reduction in complexity allows greater oversampling frequencies and consequential improvements in duty cycle.

It will be appreciated that the separation device 3 may generally separate or filter the ions according to a physico-chemical property. In particular, it is contemplated that the ions may be separated or filtered according to ion mobility and/or mass to charge ratio. The separation device 3 may comprise various known ion mobility or mass to charge separation devices. For example, the separation device 3 may comprise a drift tube or travelling wave ion mobility separator or a mass selective ion trap. Alternatively, the separation device 3 may comprise a differential ion mobility separation or filtering device such as a field-assisted ion mobility separation ("FAIMS") device, or a mass filter such as a quadrupole mass filter.

Ions may elute from the separation device 3 according to a physico-chemical property and this elution may be described by a temporal function, f(t). The temporal function f(t) may be correlated with the physico-chemical property i.e. ions eluting from the separation device 3 (and hence arriving at the Time of Flight mass analyser 4) at a particular time will be associated with a particular value of the physico-chemical property.

It will be appreciated that a separation device 3 need not be provided, and the ions may be separated only according to their (pseudo-)retention time by the chromatographic column 1 or by another molecular separation instrument disposed upstream of the ion source 2, such as an electrophoretic separation device. It will also be appreciated that the use of a chromatographic column 1 or other molecular separation instrument is not essential, and that the ions may be separated only by the separation device 3. It is also contemplated that the ions need not be separated at all prior to their arrival at the Time of Flight mass analyser 4, and may simply be provided directly from the ion source 2.

The Time of Flight mass analyser 4 may be operated in an oversampling mode so that ions arriving at the extraction region are pulsed into the Time of Flight region in a multiplexed fashion. The Time of Flight mass analyser 4 may for example be operated in an EFP mode of operation, as described in WO 2011/135477 (Verenchikov), where ions are pulsed into a Time of Flight region according to a variable or pseudo-random pulse schedule with varying pulse intervals. The pulse schedule is stored, and can then be used to demultiplex the data. However, it is also contemplated that the Time of Flight mass analyser 4 may be operated according to various other suitable multiplexed pulse schedule such that the resulting data sets are oversampled. The Time of Flight mass analyser 4 may take various forms. For instance, the Time of Flight mass analyser 4 may comprise a linear or an orthogonal acceleration mass analyser. The Time of Flight mass analyser may comprise an extended or folded flight path Time of Flight mass analyser.

The data generated by the Time of Flight mass analyser 4 may then be directed to one of N different channels 51,52 . . . of a detector system 5 according to a temporal sequence. There may be any number of different channels. For instance, the ion signals may be alternately recorded on 10 or more, 20 or more, 30 or more, 40 or more, 50 or more, 60 or more, 70 or more, 80 or more, 90 or more, up to 100, or more than 100 different channels. The data may be sequentially directed to each of the different channels in order, so that adjacent data is recorded on adjacent channels. Alternatively, the data may be directed to each of the different channels in any order, e.g. so that adjacent order is recorded on non-adjacent channels.

The sequence according to which data is recorded on the N different channels may be based on the upstream separation (i.e. based on f(t)). That is, the temporal sequence, F(t), according to which ion signals are recorded on the different channels may be based on or linked with the function describing the separation, f(t). In this way, the channel on which data is recorded may be correlated with the physico-chemical property according to which the ions have been separated. For instance, if ions elute from the separation device 3 as a pseudo-continuous beam containing a number of temporally separated components, the components that elute first may be recorded using a first channel 51 of the Time of Flight detection system 5, and the later eluting components may be sequentially recorded on a second channel 52 and on third and further channels etc. Eventually, the ion signals may start being recorded again using the first channel 51, and so on, in a cyclical manner. By changing the channel to which ion signals are directed multiple times during the course of a single cycle of separation, each of the channels 51, 52 . . . may be associated with a particular value or range of values of the physico-chemical property.

The channel on which data is being recorded may be changed sequentially or progressively. The channel may be changed continuously e.g. by continuously scanning across different physical regions of a detector. Alternatively, the channel may be changed in a discrete or stepped manner. The channel may be changed after one or more pre-determined time interval has elapsed. The time intervals may be equally spaced or may vary in length. For instance, shorter time intervals may be used where the peak density is expected or known to be greatest, whereas longer time intervals may be used for areas where peak density is expected to be lower, e.g. at the start of an experimental run. The expected peak density may be determined e.g. from a fast pre-scan, with this then being used to adjust the amount of data stored on each channel as a function of time. Typically, during the course of an experiment, ion signals may be recorded on the different channels in a cyclic manner, so that ion signals associated with multiple separate time intervals are recorded on each of the different channels. Since the data will be associated with different time intervals, the peak density for each time interval will naturally still be reduced.

As another example, the channel may be changed dynamically e.g. after a pre-defined number of ion counts or ion current or intensity is recorded on a particular channel. The pre-defined number of ion courts or ion current or intensity may be set such that the complexity of the data sets recorded on each channel is kept below a desired threshold. The complexity of a data set may e.g. be defined by the number of mass peaks in the data set or the number of overlapping mass peaks. The complexity may also be defined using the ion court, ion current or intensity of the ion signals within the data set. Suitable circuitry may be provided for dynamically recording the amount of data being recorded on each channel, and then changing the channel once a threshold value has been reached.

The channels may, for instance, be different memory locations in a data acquisition system. Alternatively/additionally, these channels may be physically distinct areas of a multiple pixel Time of Flight detector. In general, the different channels may take various suitable forms, so long as ion signals can be alternately recorded on different channels in order to reduce the complexity of the data sets recorded on each of the different channels. The channels may be arranged relative to each other in various different configurations or shapes. For instance, the channels may be arranged either linearly or in a two-dimensional array.

The data recorded on the channels may be independently processed. The data can thus be separately demultiplexed in the different channels and then combined to produce a composite mass spectrum. Various different techniques for processing and/or demultiplexing the data may be used. For instance, when an EFP oversampling technique is used, the data may be demultiplexed based on knowledge of the EFP pulse schedule. In particular, the processing techniques described in WO 2011/135477 (Verenchikov) may be used with the EFP technique. However, it will be appreciated that various other processing techniques may also be used.

Where the channel is changed in a progressive or sequential manner, the characteristics of the separation may be retained and extracted according to the channel number. For example, where the ions are separated according to ion mobility, the drift time or ion mobility value for a particular species may be extracted based on which channel their ion signal was recorded on. Alternatively, the drift time or mobility values may be reconstructed from the profile information of the pulsed rapid sampling of the Time of Flight analyser e.g. that afforded by encoded frequency pulsing.

Figures 2A, 2B, 2C, 2D, 2E:
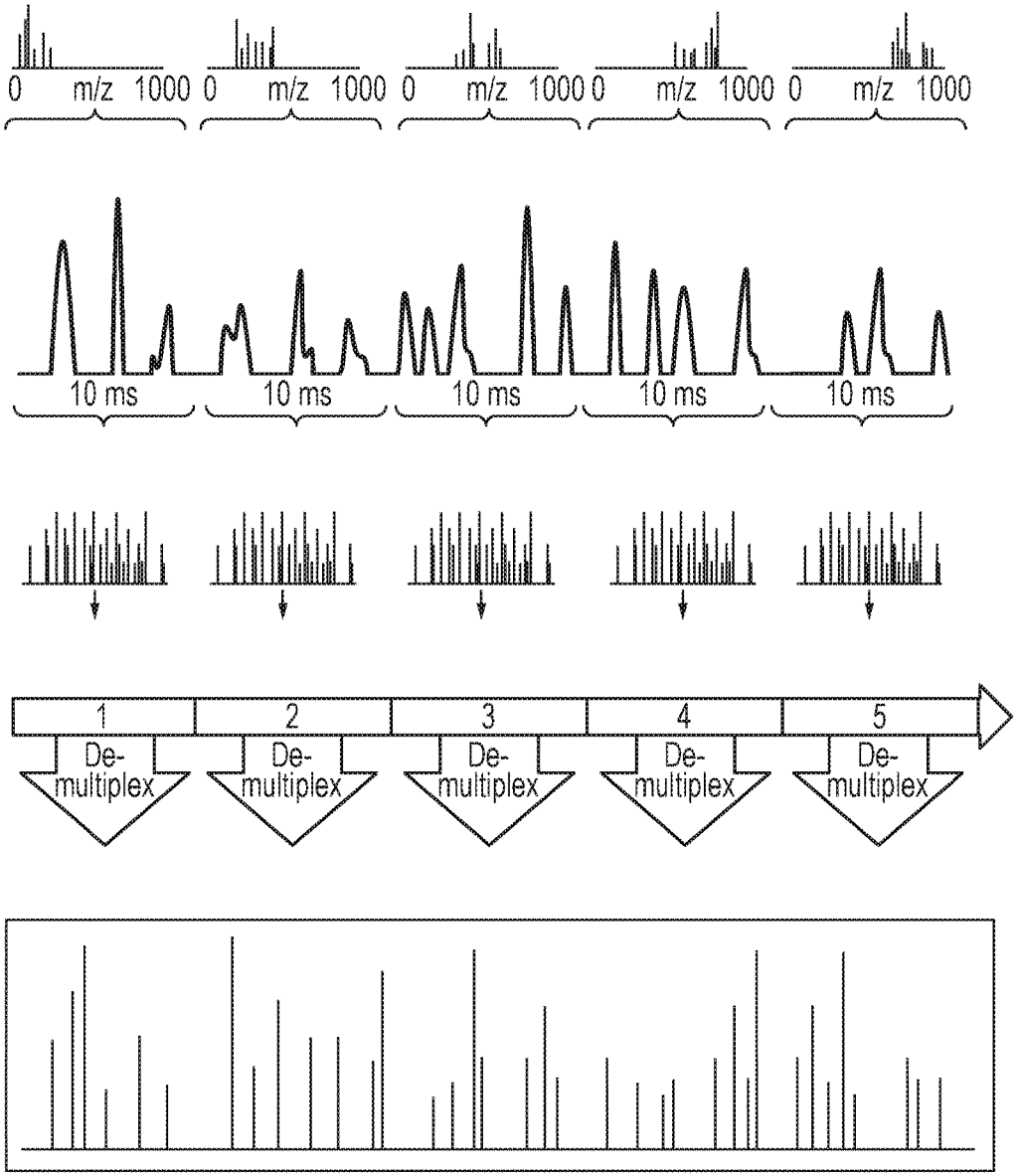
FIG. 2A illustrates mass spectra acquired without oversampling.
FIG. 2B illustrates ion mobility separation.
FIG. 2C shows mass spectra acquired in an oversampling mode of operation utilising encoded frequency pulsing.
FIG. 2D shows data being recorded on and separately demultiplexed from five separate channels and FIG. 2E shows a reconstructed mass spectrum obtained according to an embodiment.

FIGS. 2A-2E illustrate aspects of the technique in more detail. In particular, a worked example employing nested ion mobility separation with times of up to about 50 ms is illustrated. The ion mobility separation trace is shown schematically in FIG. 2B, divided into five 10 ms sections. The ion signals within each of these 10 ms sections are directed to a separate channel of the detector as shown in FIG. 2D.

FIG. 2A illustrates the underlying mass spectra (i.e. without any oversampling) for each 10 ms section of the separation shown in FIG. 2B. Each section has a unique mass spectrum. The result of the ion mobility separation is that the number of distinct mass spectral peaks in each of the five sections is reduced by, on average, a factor of five compared to the unseparated spectra.

FIG. 2C shows the mass spectra acquired with the Time of Flight analyser operating in an oversampling mode, e.g. operating using EFP. It can be seen that the duty cycle is enhanced relative to the FIG. 2A experiment, but also that the spectra recorded during each 10 ms section now contain a number of overlapping peaks that will require demultiplexing. Again, each of the channels receives data of an average complexity of about a fifth of what would be acquired if no ion mobility separation were implemented. As discussed above, the time intervals associated with each channel can be set appropriately to give the desired reduction in complexity. For instance, shorter time intervals may be used to reduce the average complexity even further, e.g. where the sample is much more complex. On the other hand, for less complex samples, it may be sufficient to use longer time intervals. It will also be appreciated that the time intervals for each channel need not be the same, and may vary in a pre-defined manner, or in real-time as the data is recorded.

However, because the data is split between different channels, as shown in FIG. 2D, the data in each channel may be demultiplexed individually. The individually demultiplexed data can then subsequently be combined to produce a composite deconvoluted mass spectrum. In this way, the spectral complexity i.e. number of peaks for each individual channel is reduced and so can be more readily demultiplexed. The technique therefore allows successful demultiplexing of very rich or complex data sets. It is apparent, therefore, that the technique allows for a substantially higher duty cycle, i.e. faster oversampled pulse rate than would have otherwise been possible. FIG. 2E shows the reconstructed mass spectra obtained by processing the mass spectra shown in FIG. 2C, obtained using a high duty cycle EFP approach.

Figure 3:
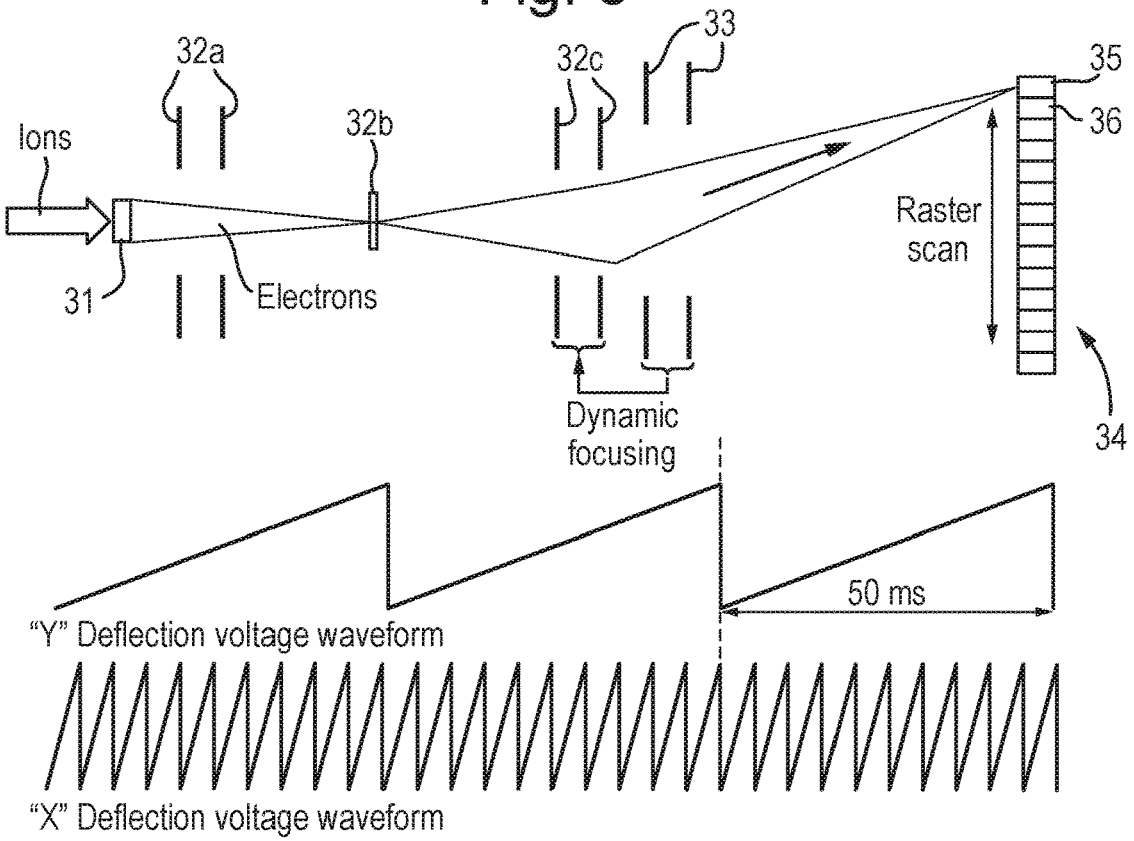
FIG. 3 shows how ions may be arranged to impinge upon a microchannel plate resulting in a beam of electrons which may then be deflected in an x- and y-direction by the application of a first deflection voltage waveform which may be applied to x-deflection electrodes and also by the application of a second deflection voltage waveform which may be applied to y-deflection electrodes.
Figure 4:
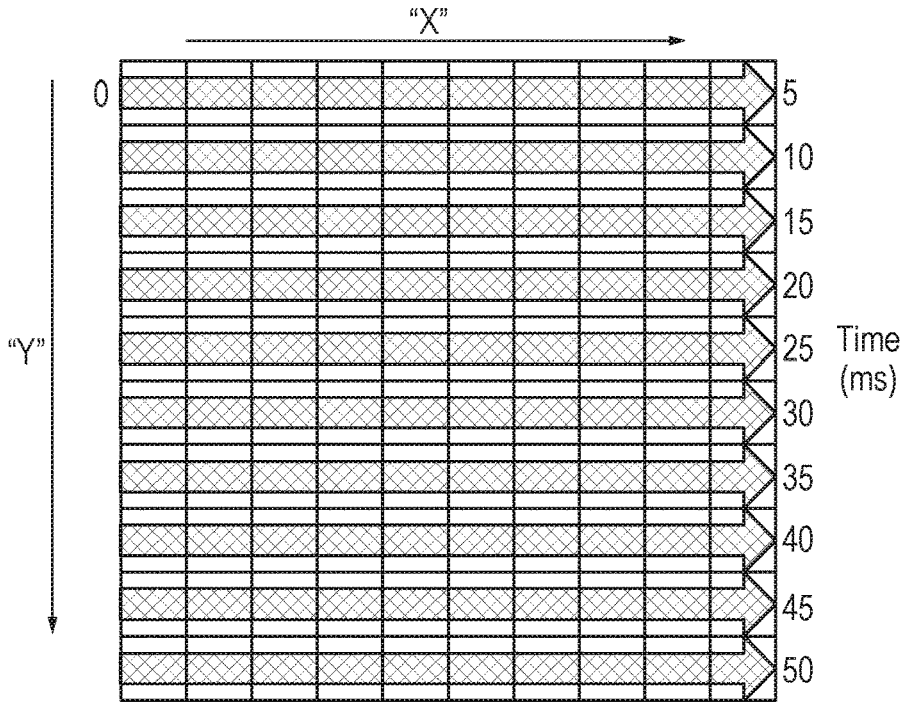
FIG. 4 shows an example of a 100 pixel detector suitable for use with the techniques described herein having a 500 μs per pixel illumination thereby allowing the detection of ions having a drift time of up to 50 ms.

FIGS. 3 and 4 illustrate an embodiment of an ion detection system suitable for use with the techniques described herein.

In the detection system shown in FIG. 3, electrons output from a first stage of ion detection (e.g. from a conversion dynode or a microchannel plate ("MCP") 31) are rastered across a multiple pixel detector so as to sequentially illuminate different areas of the detector. Each area or pixel of the detector may be demultiplexed on a separate or individual basis and each area of the detector has much less peak overlap than would be observed on the composite spectrum.

The electrons output from the MCP 31 are passed through a focussing arrangement before arriving at a pair of "x" and "y" deflection plates 33. The focussing arrangement illustrated in FIG. 3 includes a first pair of focussing lenses 32*a*, a pinhole aperture 32*b* and a second pair of focussing lenses 32*b*. However, it will be appreciated that various other ion optical or other focussing arrangements may also be used. By adjusting the potentials applied to the deflection plates 33 the electrons may be directed onto particular pixels 35,36 . . . of a multiple pixel position sensitive Time of Flight detector 34. The deflection plates 33 and focussing arrangement may be arranged to dynamically focus the electrons so that they are arranged to be focussed onto the relevant pixel of the detector 34. The electrons may e.g. be arranged to arrive at the detector with an energy greater than about 5 keV.

Suitable "x" and "y" deflection voltage waveforms which may be applied to the deflection plate 33 are shown at the bottom of FIG. 3 and may be used for the 50 ms ion mobility separation discussed in relation to FIG. 2 above. The "y" deflection voltage may be scanned over the course of the ion mobility separation i.e. over a timescale of about 50 ms. During each "y" direction scan, the "x" deflection voltage may be repeatedly scanned so that electrons are sequentially scanned across the entire area of the Time of Flight detector. This scan is then repeated for subsequent cycles of separation.

Although FIG. 3 shows an example of a suitable ion detection system wherein ions are converted into electrons for detection, it will be appreciated that various other suitable ion detection systems may also be used. For instance, the ions may be detected directly, or may be converted into photons, or other particles, for detection.

Similarly, although FIG. 3 shows one suitable focussing and deflecting arrangement, it will be appreciated that other suitable optics may be provided to focus the particles onto the detector, and to alternate the channel or region of the detector onto which the ion signals are recorded. It will be appreciated that the manner in which the ion signals are alternately recorded on the different channels may depend on the form and position of the channels, and how the channels are physically arranged relative to one another. Typically, the different channels may be located at different, fixed physical locations such that the ions may be alternately directed to a number of discrete different physical locations associated with the plurality of different channels. It is also contemplated that the direction of the ions may be continuously changed, so that the surface or area of the detector may be continuously scanned across. It is further contemplated that the detector may itself be moved such that the channels are alternately moved into position to receive the ions from the Time of Flight region. FIG. 4 shows an example of a 100 pixel detector having a 500 μs per pixel illumination time which allows for a maximum drift time of 50 ms. The electrons are repeatedly scanned across the "x" direction of the detector as the scan progressively moves down the "y" direction as indicated by the arrows. The different pixels each represent a different channel onto which ion signals can be recorded. Although the pixel detector in FIG. 4 is a square array, it will be appreciated that various other suitable sizes and/or shapes of detector may be used.

It will be appreciated that where the separation device 3 separates ions according to their ion mobility the area of the detector on which an ion signal is recorded will be correlated to the ion mobility separation time. The ion mobility or drift time of the ions may thus be determined from the pixel number. Typical oversampling rates of around 100 kHz are more than sufficient to profile ion mobility peaks. In such an oversampling scheme, the determination of ion mobility time may become part of the demultiplexing procedure, as each acceleration event advances the ion mobility separator time by a known amount until the ion mobility separation cycle is repeated.

It will be appreciated that it is not necessary to treat each individual pixel individually. For instance, groups of pixels may be demultiplexed together provided that the composite spectrum is not too complex so as to prevent successful demultiplexing. This may be done, for example, for data sets that are determined or expected to be relatively sparse or non-complex, and hence contain relatively few (overlapping) peaks.

Although the present invention has been described with reference to various embodiments, it will be understood by those skilled in the art that various changes in form and detail may be made without departing from the scope of the invention as set forth in the accompanying claims.

The invention claimed is:

1. A method of mass spectrometry comprising:

passing ions to a Time of Flight mass analyser operating in an oversampling mode of operation wherein ions are pulsed into a Time of Flight region with a pulse rate such that packets or groups of ions associated with multiple different pulses are simultaneously present in the Time of Flight region; and alternately or sequentially recording ion signals for said ions on a plurality of different channels such that the channel on which the ion signals are recorded changes over time, in order to obtain a plurality of first oversampled mass spectral data sets, each containing overlapping mass spectra associated with packets or groups of ions from multiple different pulses that were simultaneously present in the Time of Flight region, each oversampled mass spectral data set being associated with one of the plurality of different channels, wherein ions arriving at the Time of Flight mass analyser during a first time period are recorded on a first channel to obtain an associated oversampled mass spectral data set and wherein ions arriving at the Time of Flight mass analyser at a second, different time period are recorded on a second channel to obtain another associated oversample mass spectral data set.

2. A method as claimed in claim 1, further comprising:

processing each of said plurality of first oversampled mass spectral data sets to obtain a plurality of second mass spectral data sets; and combining said plurality of second mass spectral data sets to form a composite mass spectrum or mass spectral data set.

3. A method as claimed in claim 2, wherein said step of processing each of said plurality of first oversampled mass spectral data sets comprises demultiplexing each of said plurality of first oversampled mass spectral data sets to obtain said plurality of second mass spectral data sets.

4. A method as claimed in claim 1, further comprising separating or filtering said ions according to one or more physico-chemical properties prior to passing said ions to said Time of Flight mass analyser.

5. A method as claimed in claim 4, further comprising alternately or sequentially recording said ion signals for said ions on said plurality of different channels so that the oversampled first mass spectral data sets recorded on the different channels are associated with a different value or range of values of said physico-chemical property.

6. A method as claimed in claim 4, wherein said physico-chemical property comprises: (i) ion mobility; and/or (ii) differential ion mobility; and/or (iii) collision cross section ("CCS"); and/or (iv) mass or mass to charge ratio; and/or (v) chromatographic retention time.

7. A method as claimed in claim 1, further comprising alternating the channel on which ion signals are recorded dynamically after a predetermined ion signal threshold for a channel is reached.

8. A method as claimed in claim 1, wherein the step of operating said Time of Flight mass analyser in an oversampling mode of operation further comprises employing encoded frequent pulses ("EFP").

9. A method as claimed in claim 1, wherein alternately or sequentially recording ion signals on said plurality of different channels comprises scanning or rastering across an area of a multiple pixel Time of Flight detector, wherein said plurality of different channels comprise designated or discrete areas or pixels of said detector.

10. A method as claimed in claim 1, wherein said plurality of different channels comprise separate memory locations in a data acquisition system.

11. A method as claimed in claim 1, wherein alternately or sequentially recording ion signals for said ions on a plurality of different channels comprises converting the ions to electrons and passing the electrons through a dynamic focusing arrangement to focus the electrons to a particular region of a multi-pixel detector.

12. A Time of Flight mass analyser operable in an oversampling mode of operation wherein ions are pulsed into a Time of Flight region with a pulse rate such that packets or groups of ions associated with multiple different pulses are simultaneously present in the Time of Flight region, comprising:

control circuitry arranged and adapted, in said oversampling mode of operation, to alternately or sequentially record ion signals on a plurality of different channels such that the channel on which the ion signals are recorded changes over time, in order to obtain a plurality of first oversampled mass spectral data sets, wherein an oversampled mass spectral data set contains overlapping mass spectra associated with packets or groups of ions from multiple different pulses that were simultaneously present in the Time of Flight region, each oversampled mass spectral data set being associated with one of the plurality of different channels, wherein ions arriving at the Time of Flight mass analyser during a first time period are recorded on a first channel to obtain an associated oversampled mass spectral data set and wherein ions arriving at the Time of Flight mass analyser at a second, different time period are recorded on a second channel to obtain another associated oversample mass spectral data set.

13. A Time of Flight mass analyser as claimed in claim 12, further comprising a separation device for separating or filtering ions according to one or more physico-chemical properties.

14. A Time of Flight mass analyser as claimed in claim 13, wherein said separation device comprises: (i) an ion mobility or differential ion mobility separation device; (ii) a mass or mass to charge ratio separation device; (iii) a mass selective ion trap; and/or (iv) a mass selective ion filter.

15. A Time of Flight mass analyser as claimed in claim 12, wherein each of said different channels comprises a designated or discrete area or pixel of a multiple pixel Time of Flight detector.

16. A Time of Flight mass analyser as claimed in claim 15, comprising a converter for converting ions to electrons, and a pair of deflecting plates for dynamically focusing the electrons to a particular region of the multiple pixel Time of Flight detector.

17. A Time of Flight mass analyser as claimed in claim 12, wherein each of said different channels comprises a separate memory location in a data acquisition system.

18. A mass spectrometer comprising a Time of Flight mass analyser as claimed in claim 12.

* * * * *